United States Patent [19]

Altman et al.

[11] Patent Number: 5,055,816

[45] Date of Patent: Oct. 8, 1991

[54] METHOD FOR FABRICATING AN ELECTRONIC DEVICE

[75] Inventors: Leonard F. Altman, Daytona Beach; Robert E. Stengel, Ft. Lauderdale, both of Fla.

[73] Assignee: Motorola, Inc., Schaumburg, Ill.

[21] Appl. No.: 536,048

[22] Filed: Jun. 11, 1990

Related U.S. Application Data

[63] Continuation of Ser. No. 370,979, Jun. 26, 1989, abandoned.

[51] Int. Cl.[5] ..... H01F 5/00; H01F 7/06

[52] U.S. Cl. ..... 336/200; 29/602.1; 29/852; 336/229

[58] Field of Search ..... 29/602.1, 852; 336/200, 336/229

[56] References Cited

U.S. PATENT DOCUMENTS

| | | | |
|---|---|---|---|
| 2,910,662 | 10/1959 | Rex | 336/200 |
| 3,185,947 | 5/1965 | Freymoasson | 29/602.1 |
| 3,290,758 | 12/1966 | Moyer | 29/602.1 |
| 3,512,254 | 5/1970 | Jenkins et al. | 29/620 |
| 3,881,244 | 5/1975 | Kendall | 29/602.1 |
| 3,913,219 | 10/1975 | Lichtblau | 29/592 |
| 3,947,934 | 4/1976 | Olson | 29/25.42 |
| 4,035,695 | 7/1977 | Knutson et al. | 361/400 |
| 4,080,585 | 3/1978 | Molthen | 336/200 |
| 4,176,445 | 12/1979 | Solow | 29/620 |
| 4,369,557 | 1/1983 | Vandebult | 29/25.42 |
| 4,494,100 | 1/1985 | Stengel et al. | 336/200 |
| 4,536,733 | 8/1985 | Shelly | 336/200 |

FOREIGN PATENT DOCUMENTS

| | | | |
|---|---|---|---|
| 3408630 | 9/1985 | Fed. Rep. of Germany | 29/852 |
| 103320 | 6/1984 | Japan | 29/602.1 |
| 480203 | 1/1976 | U.S.S.R. | 29/852 |
| 771701 | 4/1957 | United Kingdom | 336/200 |

OTHER PUBLICATIONS

Anthony, T. R., "Forming Electrical Interconnections through Semiconductor Wafers", J. Appl. Phys., 52(8), Aug. 1981, p. 5340.

*Primary Examiner*—P. W. Echols
*Attorney, Agent, or Firm*—Juliana Agon

[57] ABSTRACT

A method of fabricating an electronic device on a carrier (14) is provided wherein the method comprises forming a hole pattern in the carrier (14), and providing a metallization pattern on the carrier, and through the holes (16, 22, etc.) to define the electronic device.

4 Claims, 4 Drawing Sheets

METHOD FOR FABRICATING AN ELECTRONIC DEVICE

This is a continuation of application Ser. No. 07/370,979 filed June 26, 1989 and now abandoned.

TECHNICAL FIELD

This invention relates generally to microelectronic components and more specifically to microelectronic inductors and coupled inductors.

BACKGROUND ART

The current trend in radio design is toward product miniaturization. For a radio to be small, it should ideally be made up of small parts or modules. One such module may be a filter, which typically contains microelectronic capacitors and inductors. Another module may be a balanced mixer, which includes capacitors and coupled inductors.

Construction of conventional microelectronic inductors is known. To provide more inductance per surface area, known inductors utilize a spiral pattern on at least one side of a substrate. To create coupling loops by this method, layers containing additional spiral patterns are added on top of the first layer, thereby increasing the height of the component.

Another known technique for creating microelectronic circuits, such as hybrid filters, requires air wound coils to be soldered on top of a substrate along with capacitors. However, since the windings of the coil are free standing, the inductance values can vary, reducing the coil's reliability. In addition, the self-resonance of the filter may subsequently change due to the variance in inductance. At high frequencies, the windings may also produce undesirable microphonics.

Therefore, a need exists to provide reliably improved performance in microelectronic components such as inductors, coupled inductors, and filters.

SUMMARY OF THE INVENTION

Accordingly, it is an object of the present invention to provide microelectronic devices that are reliable, have high inductance values and are mass-producible.

Briefly, according to the invention, a method of fabricating an electronic device on a carrier comprises forming a hole pattern in a carrier, and providing a metallization pattern on the carrier, and through the holes, to define the electronic device.

DETAILED DESCRIPTION OF THE PREFERRED EMBODIMENT

Figure 1:
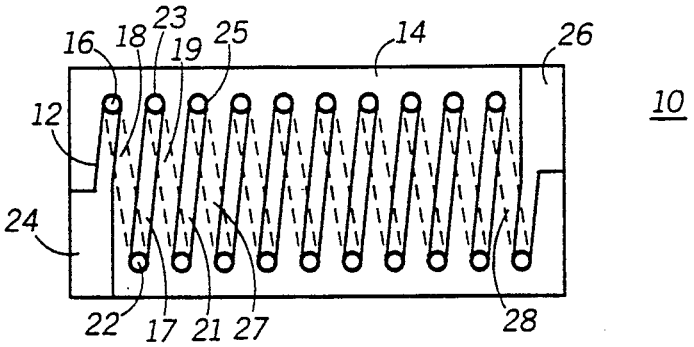
FIG. 1 is an inductor in accordance with the present invention.

Referring to FIG. 1, an inductor 10 in accordance with the present invention is illustrated. Solid and dashed lines are used to show the top and bottom windings respectively on a carrier 14. To create more inductance in a given surface area, multiple "turns" or coupling loops are produced for the inductor 10 by serially coupling a plurality of holes (16) through the carrier 14 with a metallization pattern starting from an input pad 24 (connected to a first top runner 12) and ending at an output pad 26 (connected to a last bottom runner 28). The material of the carrier may be ceramic, ferrite or other suitable material. The through-holes 16 are preferably formed by laser drilling, although punching or other suitable processes may be used. These holes are then metallized, using any suitable process so as to become electrically conductive. For simplicity, only a few "turns" will be described in detail. To form the first "turn" for the inductor 10, the runner 12 is deposited on the top side of the carrier 14 between the input pad 24 and the through-hole 16. Since the through-hole 16 is metallized, the runner 12 is coupled to a bottom runner 18, which ends at another through-hole 22. Continuing accordingly, a metallized through-hole 23 connects a top runner 17 with a bottom runner 19 to form a second "turn". A third "turn" is similarly formed by a metallized through-hole 25 connecting a top runner 21 with a bottom runner 27, and so on.

Figure 2A:
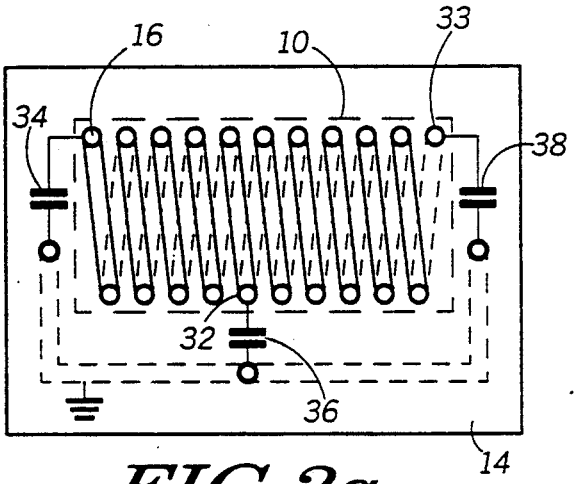
FIGS. 2*a–c* are filters in accordance with the present invention.
Figure 2B:
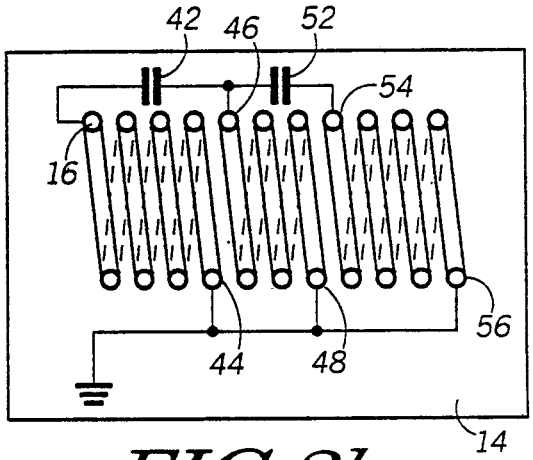
Figure 2C:
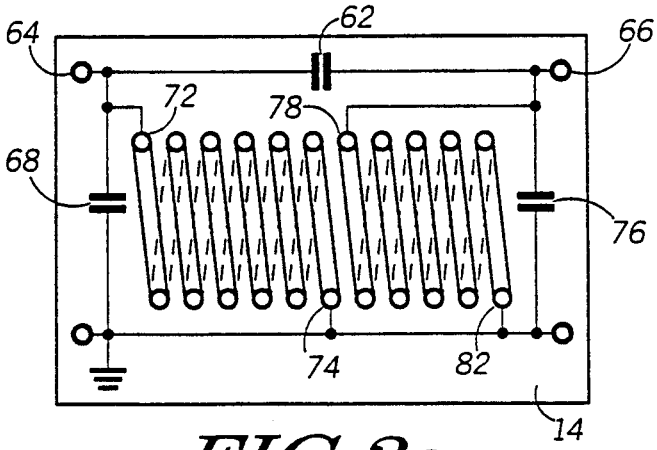

Referring to FIGS. 2*a–c*, a filter in accordance with the present invention is illustrated. The solid lines show the top runners, while the dashed lines show the bottom runners on a carrier 14. By coupling a capacitor to the inductor 10 of FIG. 1 at different points, different filter configurations may be formed (i.e., low pass, high pass and band pass).

In FIG. 2*a*, a low pass filter is formed. Three chip capacitors 34, 36, and 38 (represented schematically) are connected to an input through-hole 16, an intermediate through-hole 32, and an output through-hole 33, respectively, for coupling to ground.

Referring to FIG. 2*b*, a high pass filter is shown. The inductor 10 of FIG. 1 is altered at two different places to provide three different inductors. To form multiple inductors, runners connecting a first pair of through-holes 44 and 46, and a second pair of through-holes 48 and 54 are deleted (preferably at deposition) on the bottoom side of the carrier 14. Thus, through-holes 16/44, 46/48, and 54/56 define the beginning/ending of the first, second, and third inductor, respectively. All three inductors are grounded on their ends (44, 48 and 56). The metallized input through-hole 16 couples a capacitor 42 to the first inductor. The other end of the capacitor 42 is connected to the second inductor at the through-hole 46. A second capacitor 52 is also connected to the capacitor 42 and the second inductor at the through-hole 46. To form the output of the high pass filter, the other end of the capacitor 52 is connected to the through-hole 54 of the third inductor.

Referring to FIG. 2*c*, a capacitor 62 is connected across two parallel LC circuits on its input 64 and output 66 to form a band pass filter. A bottom runner between a pair of through-holes 74 and 78 is deleted (preferably at deposition) to transform the inductor 10 into multiple inductors. Thus, through-holes 72/74 and 78/82 define the beginning/ending of the first and second inductor. The first parallel LC circuit is formed by a capacitor 68 connected (72) to the first inductor. The other end of the capacitor 68 coupled to the through-hole 74 of the first inductor is coupled to ground. Likewise, the second parallel LC circuit is formed by a capacitor 76 connected (78) to the second inductor. The other end of the capacitor 76 is coupled to ground via the through-hole 82.

Figure 3A:
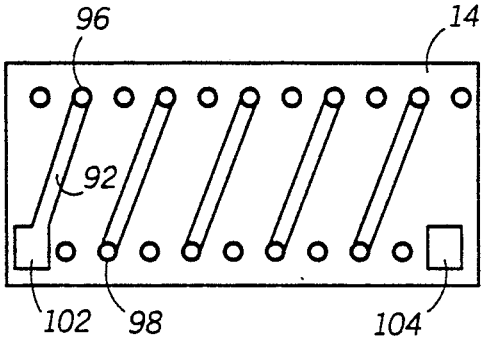
FIGS. 3*a–e* illustrates different views of a pair of coupled inductors (having a one-to-one inductance ratio) in accordance with the present invention.
Figure 3B:
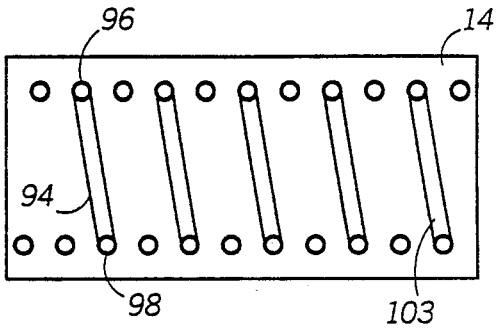
Figure 3C:
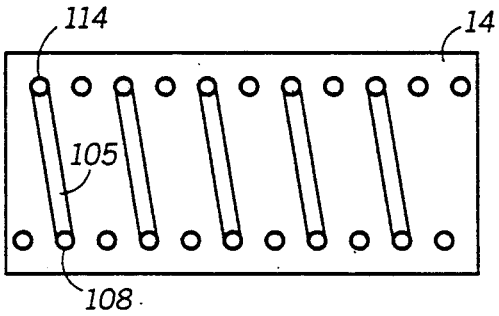
Figure 3D:
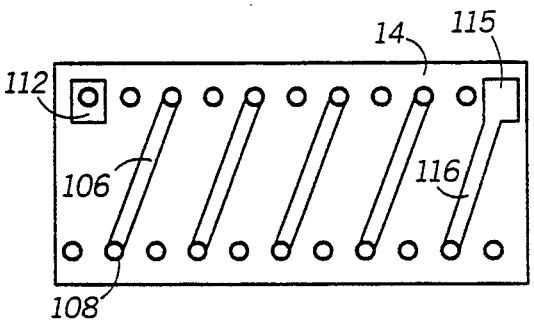
Figure 3E:
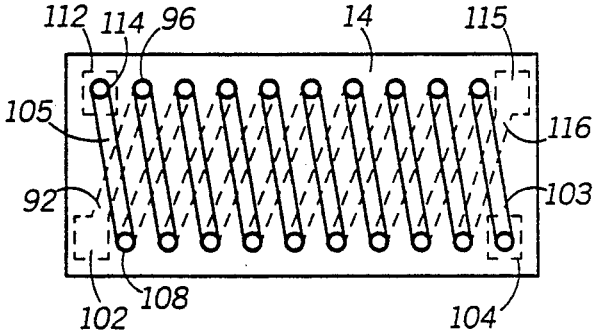

Referring to FIGS. 3*a–e*, a pair of coupled inductors (having a one-to-one inductance ratio) in accordance with the present invention is shown. Transformers are modeled as coupled inductors that have high coupling coefficient. Therefore, as used herein, the term coupled inductors includes transformers whose coupling coefficient is less than ideal (less than 1). FIGS. 3*a* and 3*d* show a bottom side of the carrier 14 for a primary and secondary "coil" respectively. Likewise, FIGS. 3*b* and 3*c* show a top side of the carrier 14 for the primary and secondary "coil" respectively. Even though both primary and secondary "coil" appear on the carrier 14 (as illustrated in FIG. 3*e* with the bottom windings shown dotted), only one "coil" is shown at one time for clarity in FIGS. 3*a–b* and FIGS. 3*c–d*. Referring to FIGS. 3*a* and 3*b*, the first "turn" of the primary "coil" is formed by an input pad 102 connected to a bottom runner 92, which is coupled to a top runner 94 by a metallized through-hole 96. The first "turn" is completed at a through-hole 98. Continued accordingly, an output pad 104 is connected to a last top runner 103. As illustrated, the primary side of the pair of coupled inductors is constructed similarly as the inductor of FIG. 1 by coupling alternating metallized through-holes.

By connecting the remaining through-holes in FIGS. 3*c* and 3*d*, the same amount of "turns" are produced for the secondary side of the pair of coupled inductors. A first "turn" of the secondary "coil" is formed by a top runner 105 connected to a bottom runner 106 by a through-hole 108. As before, an input pad 112 connected to a through-hole 114 serves as the input for the secondary "coil". To terminate a last "turn" of the secondary, an output pad 115 is connected to a bottom runner 116 in FIG. 3*d*. Referring to FIG. 3*e*, both primary and secondary "coil"s are shown together with the bottom windings represented by dashed lines.

Figure 4A:
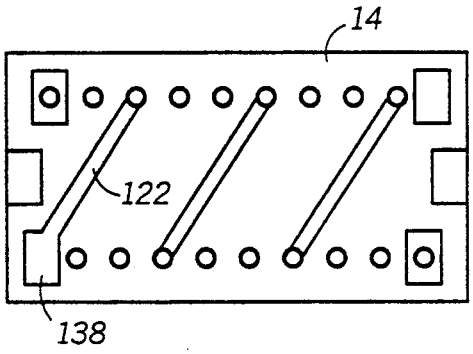
FIGS. 4*a–f* illustrates different views of a pair of coupled inductors (having a two-to-one inductance ratio) in accordance with the present invention.
Figure 4B:
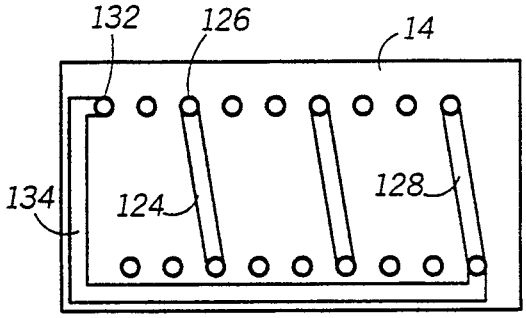

Referring to FIGS. 4*a–f*, the same method of forming "turns" is followed to form a pair of coupled inductors that has more "turns" on a primary "coil" than on a secondary "coil". Even though the first and secondary halves of a primary "coil" and a secondary "coil" are deposited on the carrier 14 simultaneously, the metallization patterns are shown separately for clarity. FIGS. 4*a* and 4*b* show a top and bottom side respectively of the carrier 14 for primary "coil". By coupling every third hole (126 for example), a first "turn" of the primary side is formed by a top runner 122 connected to a bottom runner 124 by a through-hole 126. As illustrated in FIG. 4*b*, a last "turn" on the edge of the carrier 14 is similarly formed by a runner 128 on the bottom side of the carrier 14.

Figure 4C:
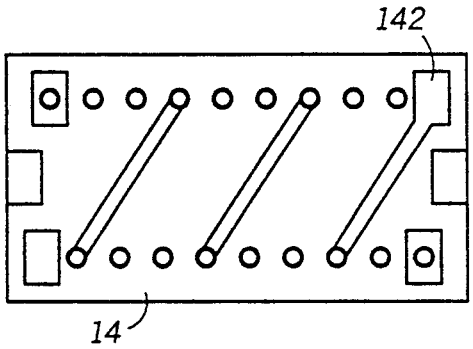
Figure 4D:
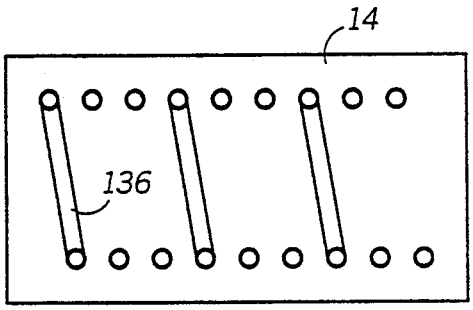

Continuing from FIG. 4*b* to FIGS. 4*c* and 4*d*, the top and bottom sides respectively of the rest of the primary "coil" are shown. To produce more "turns" for the primary "coil", the runner 128 is connected to a through-hole 132 via a path 134 to start a new series of "turns" at the other edge of the carrier 14 with a bottom runner 136. The input and output for the primary "coil" are provided at an input pad 138 and output pad 142 respectively.

Figure 4E:
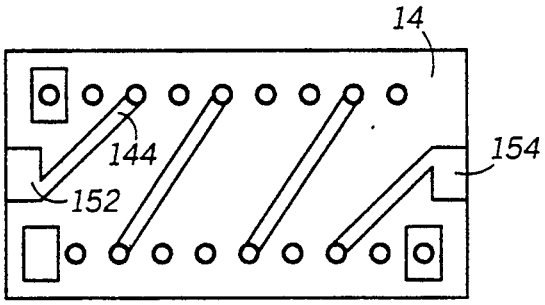
Figure 4F:
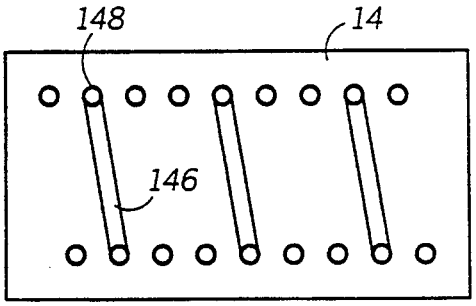

Referring to FIGS. 4*e* and 4*f*, the top and bottom windings for the secondary "coil" are respectively shown. The less "turns" of the secondary "coil" are formed starting with a top runner 144 connected to a bottom runner 146 by a through-hole 148. The input and output of the secondary "coil" are likewise provided at an input pad 152 and output pad 154 respectively.

Figure 5A:
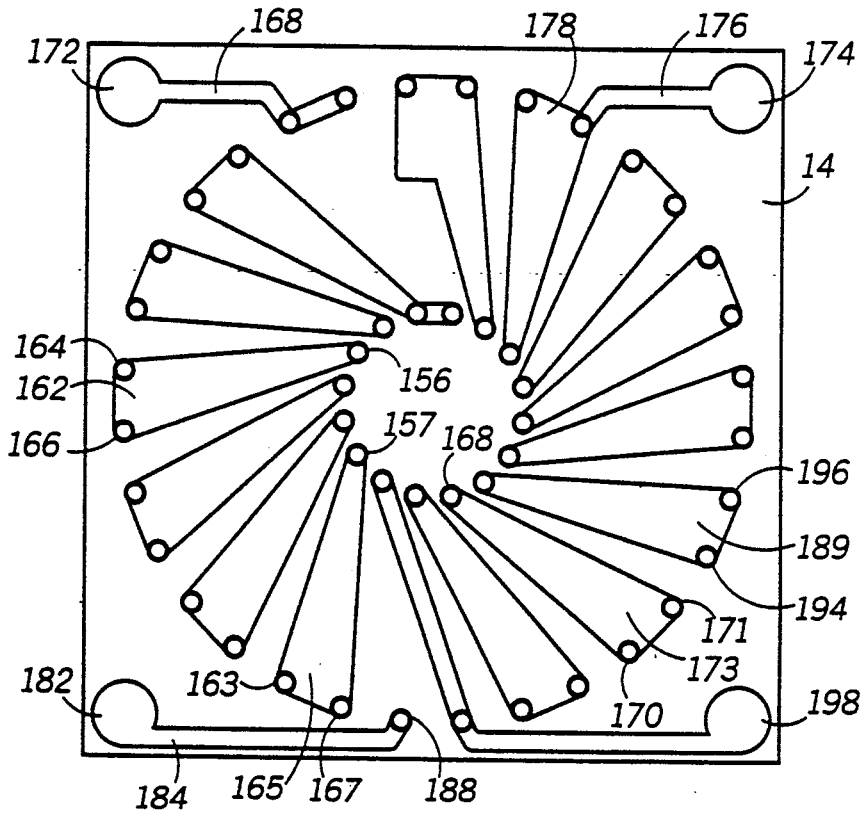
FIGS. 5*a–b* show a pair a coupled inductors with toroidal windings (having a two-to-one turn ratio) in accordance with the present invention.
Figure 5B:
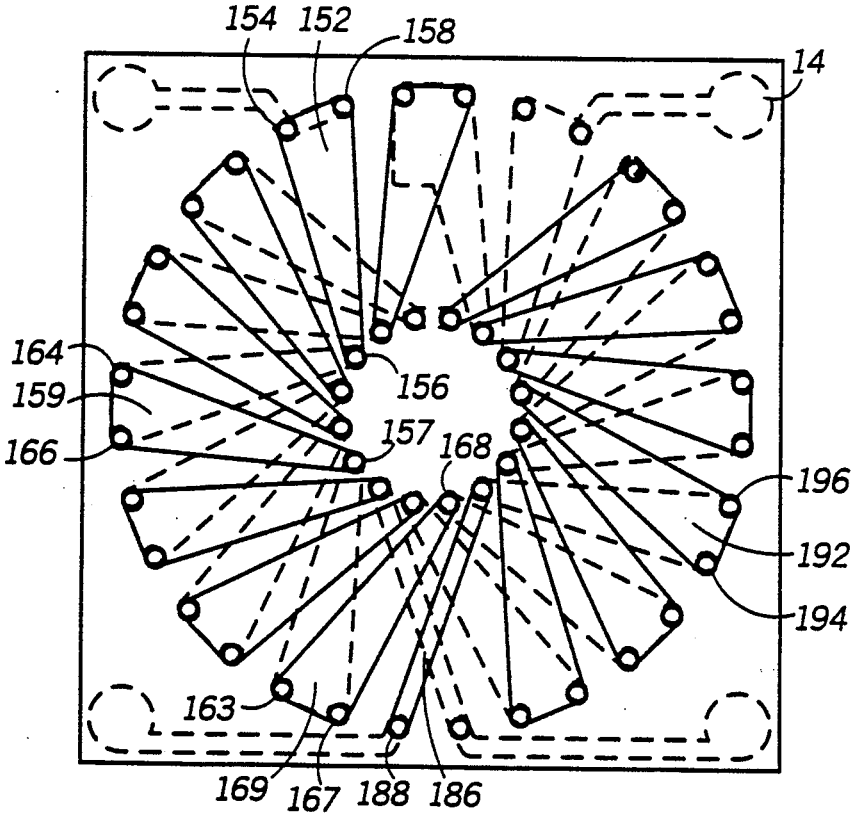

Referring to FIGS. 5*a–b*, a top and bottom side of the carrier 14 are respectively shown for a pair of coupled inductors with toroidal windings in accordance with the present invention. Just as described previously for FIGS. 4*a–f*, a turns ratio of one or more than one can be implemented by selectively interconnecting the holes to select the number of times desired to loop around a structure for each winding. For clarity, the top side of a first or primary winding is represented by dashed lines while the top side of a second or secondary winding is represented by phantom lines in FIG. 5*b*. Instead of connecting metallized holes with a strip of rectangular runner, other suitable shapes may be utilized. To connect three through-holes 156, 164, and 166, a substantially triangular metallized area 162 is deposited on a top side of the carrier 14 in FIG. 5*a*. Likewise, on a bottom side of the carrier 14, a triangular metallized area 152 connects three metallized through-holes 154, 156 and 158 at each corner of the triangle. To form a first turn of the primary "coil", an input pad 172 is connected to the triangular area 152 by a path 168. As shown in FIGS. 5*a–b*, the bottom (152) and top (162) triangles are serially connected by the through-hole 156 to complete the first "turn". By continuing in such a pattern, a metallized through-hole 157 connects a bottom trianglar metallized area 159 defined by through-holes 164, 166 and 157 (see FIG. 5*b*) with a top triangular area 165 defined by through-holes 163, 167 and 157 (see FIG. 5*a*) to form a second "turn". A third "turn"is similarly formed by a metallized through-hole 168 connecting a bottom triangular metallized area 169 defined by through-holes 163, 167 and 168 (see FIG. 5*b*) with a top triangular area 173 defined by through-holes 170, 171 and 168 (see FIG. 5*a*). Continued accordingly a second time around, a last top triangular area 178 of the primary "coil" is connected to an output pad 174 by a path 176 to implement a 2–1 turns ratio.

Likewise, an input to the secondary "coil" is provided at an input pad 182 connected to a first "turn" by a top runner 184 coupled to a bottom runner 186 via a through-hole 188. The first "turn" of the secondary "coil" is formed by connecting a top triangular area 189 to a bottom triangular area 192 via a pair of through-holes 194 and 196. Following such a toroidal pattern, the output of the secondary "coil" is provided at an output pad 198 after completing a last "turn".

What is claimed is:

1. A method of fabricating an electronic device for use as a transformer on a carrier, comprising the steps of:

a) forming a double circular pattern of metallized through-holes uniformly spaced in said carrier;

b) connecting at least triplets of said metallized through-holes to form a first set of substantially triangular metallized areas on a first side of said carrier; and c) connecting at least triplets of said metallized through-holes to form a second set of substantially triangular metallized areas on a second side of said carrier, said first and second sets being radially offset to form a pair of primary and secondary opposed coils alternating a selective number of turns of the opposed coils through said carrier and being inductively coupled with one another;

said first and second sets alternately forming at least one primary turn connected via said metallized through-holes beside a secondary turn connected via said metallized through-holes on said carrier, said metallized through-holes being substantially perpendicular to the plane of said carrier.

2. The method of fabricating an electronic device for use as a transformer of claim 1 wherein step (c) comprises said first and second sets forming a pair of primary and secondary toroidal coils crossing each other a selective number of times.

3. An electronic device for use as a transformer on a ceramic carrier, comprising:

said ceramic carrier having a double circular pattern of metallized through-holes uniformly spaced therein;

a first set of substantially triangular metallized areas on a first side of said carrier each component of said first set of substantially triangular metallized areas formed by connecting at least a triplet of said metallized through-holes; and a second set of substantially triangular metallized areas on a second side of said carrier each component of said second set of substantially triangular metallized areas formed by connecting at least a triplet of said metallized through-holes, said first and second sets skewed radially disposed forming a pair of primary and secondary coils intermixed a selective number of times through said carrier and being inductively coupled with one another.

4. The electronic device of claim 3 wherein said first and second sets forming a pair of primary and secondary coils intermixed through said carrier and being inductively coupled with one another to constitute a microelectronic transformer.

* * * * *